US009408776B2

(12) United States Patent
Oschwald

(10) Patent No.: US 9,408,776 B2
(45) Date of Patent: Aug. 9, 2016

(54) MEDICINE BOTTLE INCLUDING A RISER TUBE

(71) Applicant: Optipharma GmbH, Frankfurt am Main (DE)

(72) Inventor: Hans Oschwald, Franfurt (DE)

(73) Assignee: Optipharma GmbH, Frankfurt am Main (DE)

( * ) Notice: Subject to any disclaimer, the term of this patent is extended or adjusted under 35 U.S.C. 154(b) by 0 days.

(21) Appl. No.: 14/338,461

(22) Filed: Jul. 23, 2014

(65) Prior Publication Data

US 2015/0034583 A1 Feb. 5, 2015

(30) Foreign Application Priority Data

Jul. 31, 2013 (DE) ..... 20 2013 006 898 U

(51) Int. Cl.

| | |
|---|---|
| ***B67D 7/78*** | (2010.01) |
| ***A61J 1/00*** | (2006.01) |
| ***A61J 7/00*** | (2006.01) |
| ***A61J 1/14*** | (2006.01) |
| *A61J 9/00* | (2006.01) |

(52) U.S. Cl.

CPC .... *A61J 1/00* (2013.01); *A61J 1/14* (2013.01); *A61J 7/0046* (2013.01); *A61J 9/005* (2013.01)

(58) Field of Classification Search

CPC ..... A61J 1/00; A61J 1/14; A61J 7/0046; A61J 9/005; B65D 1/323; B65D 83/32; B65D 2231/004; B65D 2588/545; B67D 1/0802; B67D 3/0064; B67D 2001/0824; B67D 2001/0825; B05B 11/042; B05B 15/005

USPC ..... 222/464.7, 321.5

See application file for complete search history.

(56) References Cited

U.S. PATENT DOCUMENTS

| | | | | |
|---|---|---|---|---|
| 2,286,957 A | | 6/1942 | Du Val et al. | |
| 2,446,917 A | * | 8/1948 | Gaimari | A61J 9/00 215/11.4 |
| 3,184,118 A | | 5/1965 | Webster | |
| 3,618,829 A | * | 11/1971 | Elmore | B05B 11/047 222/209 |
| 4,220,285 A | * | 9/1980 | Gualdi | B05B 1/12 222/383.1 |
| 4,286,735 A | | 9/1981 | Sneider | |

(Continued)

FOREIGN PATENT DOCUMENTS

| | | | | |
|---|---|---|---|---|
| DE | 6670 C | | 12/1878 | |
| EP | 361079 A1 | * | 4/1990 | B65D 47/34 |
| WO | 03101858 A2 | | 12/2003 | |

OTHER PUBLICATIONS

HAAG, Den, EP 2 832 341 A1, European Search Report, Dec. 3, 2014, 3 pages.

*Primary Examiner* — Patrick M Buechner
(74) *Attorney, Agent, or Firm* — LaBatt, LLC

(57) ABSTRACT

A medicine bottle including a bottle body and a bottle top attached to the bottle body is provided. The bottle body has an inner space to receive a medicine. The bottle top includes a riser tube projecting into the inner space to facilitate pumping the medicine through the riser tube and out of the medicine bottle. The inner space can be delimited by a bottom side of the bottle body. The height of the bottom side varies over a base area of the bottle body between a maximum height and a minimum height. This allows the medicine to accumulate in the region of the minimum height when the medicine is below a particular level. Additionally, a length of the riser tube can be chosen such that the riser tube projects further into the inner space than to the maximum height of the bottom side.

19 Claims, 1 Drawing Sheet

(56) References Cited

U.S. PATENT DOCUMENTS 4,821,923 A * 4/1989 Skorka ..... B05B 11/0081 206/219
5,062,549 A * 11/1991 Smith ..... B05B 11/0059 222/184
5,211,298 A 5/1993 Bloch
5,366,119 A * 11/1994 Kline ..... B05B 15/005 222/180
5,435,464 A * 7/1995 Alexander ..... B05B 11/0043 222/105
5,529,244 A * 6/1996 Horvath, Jr. ..... A01C 23/042 138/44
5,910,138 A * 6/1999 Sperko et al. ..... 604/408
6,076,708 A 6/2000 Ceccarelli et al.
6,257,446 B1 * 7/2001 Pike ..... B65D 75/5883 222/464.7
6,290,090 B1 9/2001 Essebaggers
6,302,304 B1 * 10/2001 Spencer ..... B05B 11/0051 222/256
6,468,377 B1 * 10/2002 Sperko et al. ..... 156/229
6,648,201 B1 * 11/2003 Marinaro ..... B65D 31/16 222/105
2001/0032864 A1 * 10/2001 Shepherd ..... B05B 11/0037 222/321.5
2003/0089744 A1 * 5/2003 Mandile ..... B67D 1/08 222/464.3
2004/0040985 A1 3/2004 Gatton, Jr. et al.
2005/0236433 A1 * 10/2005 Weck ..... B05B 11/0037 222/382
2006/0144868 A1 * 7/2006 Brisbois ..... B05B 11/0037 222/377
2006/0186144 A1 * 8/2006 Tinsley ..... B05B 11/0037 222/377
2008/0023499 A1 * 1/2008 Knight ..... B05B 11/0037 222/464.7
2008/0302831 A1 * 12/2008 Wang ..... B05B 11/0086 222/321.5
2009/0230153 A1 * 9/2009 Knight ..... B05B 11/0037 222/382
2009/0294468 A1 * 12/2009 Tom ..... B05B 11/0037 222/1
2011/0011895 A1 * 1/2011 Michitsuji ..... B05B 11/3001 222/382
2012/0006855 A1 * 1/2012 Ehrmann ..... B05B 11/0037 222/377

* cited by examiner

MEDICINE BOTTLE INCLUDING A RISER TUBE

The current application claims priority to German Utility Model No. 20 2013 006 898.1, which was filed on 31 Jul. 2013, and which is hereby incorporated by reference.

The present invention relates to a medicine bottle according to the preamble to claim 1.

A generic medicine bottle comprises a bottle body which has an inner space to receive a medicine. In addition a bottle top is provided which is attached to the bottle body. The bottle top has a riser tube which projects into the inner space in order to facilitate a pumping of the medicine out of the inner space through the riser tube and out of the medicine bottle.

The medicine can be in principle any liquid which is to be taken by a user. In particular it can be a liquid to be taken orally or nasally.

The bottle top can in principle also be formed integrally with the bottle body. However, the bottle top is preferably screwed onto the bottle body or placed thereon.

The riser tube must project downwards into the liquid medicine in order to be able to convey this out of the medicine bottle. The pumping hereby required can be provided in a simple case by a user pressing on elastic outer walls of the bottle body. Alternatively or additionally, a pumping mechanism can also be present in the bottle top. In this case a user moves a component of the bottle top relative to the bottle body in order to bring about a pumping of the medicine through the riser tube and out of the medicine bottle.

The production costs of a medicine can be very high. It is therefore desirable for a medicine to be as far as possible completely removable from a medicine bottle in a simple way.

In the case of conventional medicine bottles a relatively large amount of medicine remains behind which cannot be removed via the riser tube.

It can thus be regarded as an object of the invention to provide a medicine bottle, from which a medicine can be as far as possible completely removed in a simple way.

This object is achieved through a medicine bottle having the features of claim 1.

Preferred embodiments of the medicine bottle according to the invention are indicated in the dependent claims and are explained in the following description.

In the case of the medicine bottle of the abovementioned type it is provided according to the invention that the inner space is delimited by a bottom side, the height of which varies over a base area of the bottle body between a maximum height and a minimum height, in order to facilitate, in the event of a low fill level of the medicine, a collection of the medicine in the region of the minimum height. In addition the length of the riser tube is selected so that the riser tube projects further than to the maximum height of the bottom side into the inner space.

It can be regarded as a core idea of the invention to form the bottom side in such a way that, in the event of a low fill level of the medicine, said medicine does not collect over the whole base area but only a part of the base area of the bottle body. In this relatively small region a small remaining amount of the medicine has a higher fill level than in the case of a conventional medicine bottle, in which the bottom side is horizontal. It is thus possible for a small remaining amount of the medicine to be removed more easily via the riser tube. The length of the riser tube is thereby crucial. A lower end of the riser tube must thus project downwardly as far as a height in the inner space which is lower than the maximum height of the bottom side of the inner space.

The base area, over which the height of the bottom side varies, is intended to describe the lower area of the bottle body. For example the base area can be divided into a central region and an edge region. The height of the bottom side can be different in these two regions and is preferably higher in the central region than in the edge region.

The edge region can be formed in the case of medicine bottles with a round cross-section as an annular region. A region of the bottom side with minimum height is then formed by the annular region. The bottom side is lower within the annular region than in the area enclosed by the annular region.

The length of the riser tube is preferably selected so that it extends as far as the minimum height of the bottom side. The medicine can thereby be removed substantially completely through the riser tube. The riser tube can thereby contact, with a lower end, the bottom side. The riser tube can expediently be made of a flexible material. If, when assembling the medicine bottle, the bottle top is placed with the riser tube onto the bottle body and lowered, the riser tube contacts the bottom side initially in a region which generally does not have the minimum height. Due to the arched bottom side, which preferably has an inwardly raised round form, and on account of the flexibility of the riser tube, said riser tube can slide during assembly of the medicine bottle along the bottom side until it reaches a region of the bottom side with minimum height. In other words the riser tube slides during assembly along the bottom side until the lower end of the riser tube is immersed into the described annular region.

According to this embodiment the length of the riser tube is at least as long as a connecting straight line from an upper end of the riser tube to the region of the bottom side with the minimum height. Since the riser tube generally extends in a curved manner within the inner space, the length of the riser tube is preferably greater than the aforementioned connecting straight line.

The length of the riser tube and the shape of the bottom side are preferably selected so that the riser tube projects as far as a depth, at which at least 70%, preferably at least 80%, of the area of the bottom side is located above the lower end of the riser tube. The area, over which medicine collects/accumulates in the case of a low fill level, is hereby advantageously very small. It is furthermore preferred that at most 90% of the area of the bottom side lies above the lower end of the riser tube. An inclination of the medicine bottle thereby has a relatively small effect upon the extent of a non-removable remaining amount of medicine.

It is particularly preferable that the bottom side is arched in the direction of the bottle top. The region of the bottom side with a maximum height can be located here in the middle of the base area of the medicine bottle. The height of the bottom side thereby decreases towards the edge of the base area.

This shape of the bottom side is preferably used if a shape of the lower side of the bottle body equates to the shape of the bottom side of the inner space. The lower side of the bottle body can thus likewise be upwardly arched, whereby the bottle bottom can have an approximately constant thickness. This facilitates the production of the medicine bottle. In addition, secure standing of the medicine bottle can hereby be achieved, whereby said medicine bottle contacts a ground solely at the outer edge of the lower side of the bottle body. Finally, it is also hereby possible for the material quantity required for the bottle body to be kept low.

In order to achieve an increased arching of the bottom side in the direction of the bottle top, the thickness of the bottle bottom can be greater in a central region of the bottle bottom than at the edge of the bottle bottom. In particular if the bottle body is produced from a deformable material, for example plastic, it can hereby be ensured that the bottom side of the inner space is definitely upwardly arched in the middle.

The bottom side can have in its edge region a height which is independent of the azimuth angle. The azimuth angle thereby indicates a direction perpendicular to the vertical axis of the bottle body.

In principle, however, it can also be provided that a height of the bottom side increases towards the edge of the base area. The region of the bottom side with minimum height can be formed here within a central region of the base area of the bottle body. According to this embodiment a particularly large percentage of the medicine received can be removed via the riser tube. In comparison with the previously described embodiments, however, in general the total amount of medicine which can be received in a medicine bottle with previously defined outer dimensions is lower.

For a particularly efficient removal of the remainder, a transition from the bottom side to side walls of the bottle body can be rounded off. The side walls describe the generally vertical shell surface which laterally delimits the inner space. This formation is particularly advantageous if the bottom side is upwardly arched in the centre thereof.

It can further be provided, for the purpose of emptying the remainder as completely as possible, for a lower end of the riser tube to have at least one notch on an end face. The end face of the riser tube is not therefore planar, but instead deepens through the notch. The notch forms a radial connection between the inner space of the riser tube and the environment. Not only liquid which is located in the radial direction of the lower riser tube portion is thus sucked in with the riser tube. Instead, liquid can additionally be received from a lateral region with respect thereto, whereby an improved emptying of the remainder is achieved.

For simple manufacturing, the notch can have a V-shape. In addition two notches lying one opposite the other can be provided on the end face.

The lower end of the riser tube preferably has a conical form in regions between the notch(es) which tapers towards the end of the riser tube. The entry opening into the riser tube, which is initially enlarged by the V-shaped notches, is in turn reduced by the conical form. A suction force can thereby be achieved at the desired level and hence an improved emptying of the remainder.

In principle the bottle body can be produced from any material which can also include glass. The bottle body is, however, preferably produced from plastic. The desired shaping of the bottom side can thereby be achieved in a simple production.

In order to protect a medicine in the inner space against light irradiation the bottle body is preferably impermeable to light.

Further features and advantages of the invention are described below by reference to the attached schematic drawing, in which.

The same components or those working in the same way are provided in the two figures with the same reference numerals.

Figure 1:
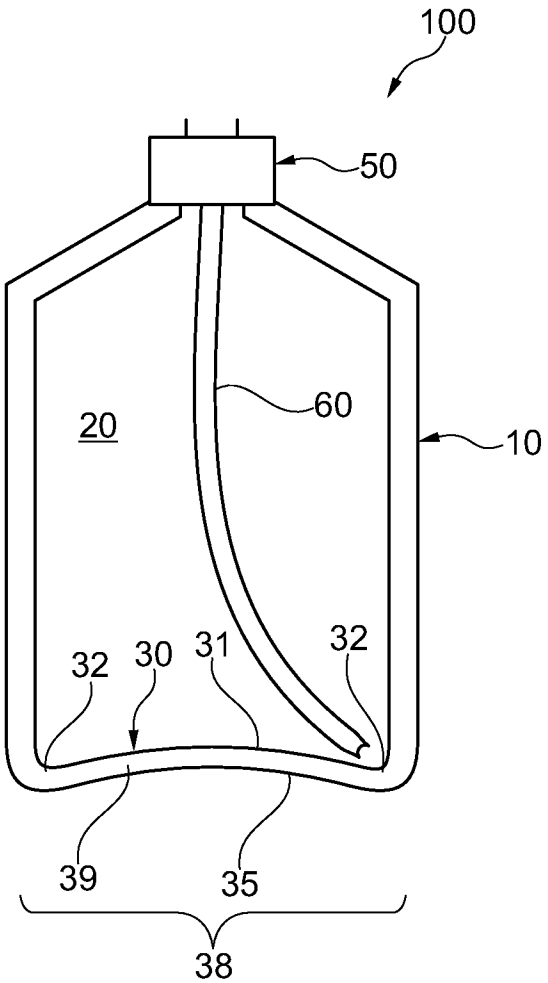
FIG. 1 shows schematically a cross-section of an exemplary embodiment of a medicine bottle according to the invention.

FIG. 1 shows a cross-sectional view of a medicine bottle 100 according to the invention. This comprises a bottle body 10 and a bottle top 50 which is placed onto the bottle body 10. The bottle top 50 can either upwardly end the bottle body 10 or have connecting means for a further component.

An inner space 20 is formed in the bottle body 10, in which inner space 20 a liquid medicine can be located.

In order to remove the medicine a riser tube 60 is present. This is fixed to the bottle top 50 and has at its lower end an opening to receive the medicine.

If a fill level of the medicine falls to a level below the opening of the riser tube 60, no further medicine can be removed with said riser tube 60. According to the invention, through the formation of the bottom side 30 of the inner space 20 together with a certain length of the riser tube 60 it is ensured that a medicine can be substantially completely removed.

As a first measure, a height of the bottom side 30 is not constant over the base area 38 of the bottle body 10. The base area 38 can be understood to be the cross-sectional area of the inner space 20 perpendicular to a vertical axis of the bottle body 10. The bottom side 30 has at least one region with maximum height 31 and at least one region with minimum height 32. The height is to be understood along the vertical axis of the bottle body 10.

In the example of FIG. 1 a bottom wall 39 of the bottle body 10 is upwardly arched. The region with maximum height 31 is thereby in the middle of the base area 38. The region with minimum height 32 is consequently an annular region at the outer edge of the bottom side 30.

With decreasing fill level of the medicine, initially the central region with maximum height 31 is no longer covered by the medicine. The medicine collects instead in the annular region with minimum height 32.

As the riser tube 60 contacts the bottom side 30 on the region with minimum height 32 the medicine can be virtually completely removed. The length of the riser tube 60 is hereby crucial. Said riser tube 60 is longer than a distance from the upper end of the riser tube 60 to the region with minimum height 32. It is thereby ensured that, when assembling the bottle body 10 and the bottle top 50, the riser tube 60 initially contacts the region with maximum height 31. If the bottle top 50 is lowered further downwards onto the bottle body 10, the lower end of the riser tube 60 is moved along the bottom side 30 in the direction of the region with minimum height 32. A flexible design of the riser tube 60 is necessary for this.

In the example shown the transition from the bottom side 30 to the vertical side wall is formed as a curved area. The region with minimum height 31 does not thereby directly abut the vertical side wall and a particularly efficient emptying of the remainder of the bottle 100 can be achieved.

As shown in FIG. 1, the lower end of the riser tube has a V-shaped notch. In addition the riser tube tapers in the region of the notch towards its end. In other words, the form of the riser tube end is conical at both regions which lie between the V-shaped notches. Even very small remaining amounts of medicines can thereby be removed.

For simple and cost-saving production, a lower side 35 of the bottle body 10 has the same shape as the bottom side 30 of the inner space 20. With the upward curvature as shown, moreover, secure standing of the medicine bottle 100 can also be ensured.

Figure 2:
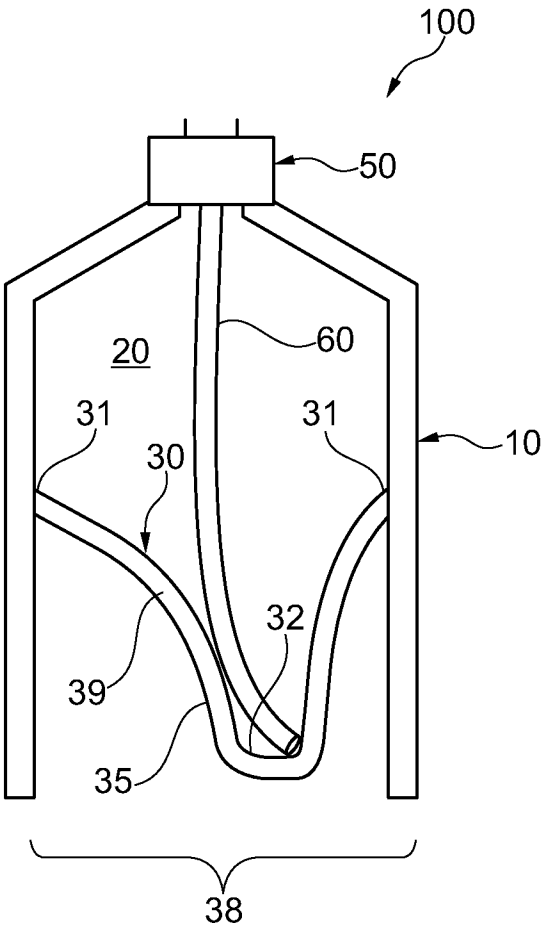
FIG. 2 shows schematically a cross-section of a further exemplary embodiment of a medicine bottle according to the invention.

A further exemplary embodiment of a medicine bottle 100 according to the invention is shown in a cross-section in FIG. 2. This exemplary embodiment differs from that of FIG. 1 in the form of the bottom wall 39 of the bottle body 10. Here, the region with minimum height 32 of the bottom side 30 is not located at the edge of the base area 38. Instead, the region with minimum height 32 has an approximately circular form and lies in a central region of the base area 38 or between a central region and an outer edge of the base area 38. The region with maximum height 31 of the bottom side 30 is thus located at the edge of the base area 38 and abuts the side walls of the bottle body 10.

Through this form, the effects of inclined holding of the medicine bottle 100 upon the remaining amount of medicine which cannot be removed via the riser tube 60 are reduced.

In order to guarantee secure standing, the side walls of the bottle body 10 extend downwards, here, at least as far as the lowest point of the lower side 35 of the bottom wall 39, preferably further. The bottle body 10 thus stands solely with an annular region on a sub-surface.

Irrespective of the specific formation of the bottom side 30 of the inner space 20, a non-removable remaining amount of medicine can already be very greatly reduced if the bottom side has a region with maximum height 31 and a region with minimum height 32 and the riser tube 60 contacts the region with minimum height 32. In comparison with conventional medicine bottles, the medicine bottle 100 according to the invention can thus ensure that an expensive medicine can be substantially completely used.

The invention claimed is:

1. A medicine bottle, comprising:

a bottle body which has an inner space to receive a medicine, and a bottle top which is attached to the bottle body, wherein the bottle top has a riser tube which projects into the inner space in order to facilitate a pumping of the medicine out of the inner space through the riser tube and out of the medicine bottle, wherein the inner space is delimited by a bottom side, of which the height varies over a base area of the bottle body between a maximum height and a minimum height, to allow the medicine to accumulate in the region of the minimum height in the case of a low fill level of the medicine, and a length of the riser tube is chosen such that the riser tube projects further into the inner space than to the maximum height of the bottom side, wherein a lower end of the riser tube includes an end face having a riser tube entry opening, a first notch and a second notch opposite therefrom that enlarge the riser tube entry opening to form a radial and lateral connection with the inner space of the bottle body to receive medicine from the inner space in both a radial and lateral direction, and a conical region having a conical form between the first notch and the second notch that tapers towards the end face, reducing the enlarged riser tube entry opening formed by the first notch and the second notch in accordance with the conical form to a reduced riser tube entry opening.

2. The medicine bottle of claim 1, wherein the length of the riser tube is selected so that it extends as far as the minimum height of the bottom side.

3. The medicine bottle of claim 1, wherein the length of the riser tube is at least as long as a connecting straight line from an upper end of the riser tube to the region of the bottom side with the minimum height.

4. The medicine bottle of claim 1, wherein the riser tube comprises a flexible material which allows, during assembly of the bottle top on the bottle body, the riser tube to initially contact a raised region of the bottom side and, in the event of a further lowering of the bottle top onto the bottle body, said riser tube bends and a lower end of said riser tube is displaced in the direction of the region of the bottom side with the minimum height.

5. The medicine bottle of claim 1, wherein the length of the riser tube and the shape of the bottom side are selected so that the riser tube extends as far as a depth, at which at least 70% of the area of the bottom side is located above the lower end of the riser tube.

6. The medicine bottle of claim 1, wherein the bottom side is arched in the direction of the bottle top.

7. The medicine bottle of claim 1, wherein a shape of the lower side of the bottle body equates to the shape of the bottom side of the inner space.

8. The medicine bottle of claim 1, wherein a height of the bottom side increases towards the edge of the base area.

9. The medicine bottle of claim 1, wherein the bottle body is produced from plastic.

10. The medicine bottle of claim 1, wherein the bottle body is impermeable to light in order to protect a medicine in the inner space against light irradiation.

11. The medicine bottle of claim 1, wherein a transition from the bottom side to side walls of the bottle body is rounded off.

12. The medicine bottle of claim 1, wherein the enlarged riser tube entry opening and the reduced riser tube entry opening each has a size that is smaller or equal to a cross-sectional area of the riser tube.

13. The medicine bottle of claim 1, wherein the reduced riser tube entry opening established by the conical form of the conical region provides an increased suction force that compensates for a reduced suction force due to the enlarged riser tube entry opening formed by the first notch and the second notch.

14. The medicine bottle of claim 1, wherein each of the first notch and the second notch has an arched surface.

15. A bottle, comprising:

a bottle body having a bottom side with each end of the bottom side defining a maximum height of the bottom side and a portion formed between each bottom side end defining a minimum height of the bottom side, a pair of opposing vertically extending side walls with each vertically side wall coupled to one of the bottom side ends, wherein the bottom side slopes downward from one vertically extending side wall at the maximum height to the portion having the minimum height and slopes upward to the other vertically extending side to the other end of the bottom side having the maximum height, a pair of slanting side walls, each slanting side wall extending inward to each other from an end of one of the vertically extending side walls, and an inner space formed between the bottom side, the pair of vertically extending side walls and the pair of slanting side walls that receives a liquid, wherein the liquid accumulates in the portion of the bottom side having the minimum height as a liquid level in the inner space drops below the bottom side ends having the maximum height and moves towards the portion with the minimum height;

a bottle top with an opening formed therein that is coupled to the pair of slanting side walls; and a riser tube that extends through the opening of the bottle top into the inner space of the bottle body in order to facilitate a pumping of the liquid out from the inner space, wherein the riser tube includes a flexible material that is configured to contact a surface of the bottom side with placement into the portion of the bottom side having the minimum height, wherein a lower end of the riser tube includes an end face having a riser tube entry opening, a first notch and a second notch opposite therefrom, each having an arched surface that enlarges the riser tube entry opening to form a radial and lateral connection with the inner space of the bottle body to receive medicine from the inner space in both a radial and lateral direction.

16. The bottle of claim 15, wherein the portion of the bottom side having the minimum height is sloped downward from one end of the portion of the bottom side to an opposing end, wherein the liquid collects in an end of the portion of the bottom side as the liquid level in the inner space drops in the portion of the bottom side having the minimum height.

17. The bottle of claim 15, wherein the riser tube further includes a conical region having a conical form between the first notch and the second notch that tapers towards the end face, reducing the enlarged riser tube entry opening formed by the first notch and the second notch in accordance with the conical form to a reduced riser tube entry opening.

18. The bottle of claim 17, wherein the reduced riser tube entry opening established by the conical form of the conical region provides an increased suction force that compensates for a reduced suction force due to the enlarged riser tube entry opening formed by the first notch and the second notch.

19. The bottle of claim 17, wherein the enlarged riser tube entry opening and the reduced riser tube entry opening each has a size that is smaller or equal to a cross-sectional area of the riser tube.

* * * * *